US005625501A

United States Patent [19]

Taggert

[11] Patent Number: 5,625,501

[45] Date of Patent: Apr. 29, 1997

[54] TRUE IMAGE MIRROR

[76] Inventor: Anthony J. Taggert, 435 E. 65th St., Apt. 8A, New York, N.Y. 10021

[21] Appl. No.: 307,557

[22] Filed: Sep. 16, 1994

Related U.S. Application Data

[63] Continuation of Ser. No. 993,639, Dec. 21, 1992, abandoned.

[51] Int. Cl.[6] ..... G02B 5/08; G02B 7/182

[52] U.S. Cl. ..... 359/855; 359/860; 359/862

[58] Field of Search ..... 359/855, 856, 359/860, 862, 865

[56] References Cited

U.S. PATENT DOCUMENTS

| | | | |
|---|---|---|---|
| 813,136 | 2/1906 | Balch | 359/856 |
| 3,022,709 | 2/1962 | Duggan | 359/856 |
| 4,580,880 | 4/1986 | Watson | 359/860 |
| 4,639,102 | 1/1987 | Fetko | 359/862 |
| 4,720,184 | 1/1988 | Watson | 359/856 |

FOREIGN PATENT DOCUMENTS

| | | | |
|---|---|---|---|
| 56968 | 8/1982 | European Pat. Off. | 359/856 |
| 3921-103-A | 11/1990 | Germany | 359/855 |

*Primary Examiner*—David C. Nelms
*Assistant Examiner*—Son Mai
*Attorney, Agent, or Firm*—Panitch Schwarze Jacobs & Nadel, P.C.

[57] ABSTRACT

A non-reversing image mirror device is provided which is fabricated out of a single kind identical mirror units, with a front mirrored surface whereby the image produced has a centerline split which is virtually invisible or at least minimal when compared to devices mirrored on a rear surface. The mirror units are pivotally connected together at the mitered side edges for relative swinging of the mirror units between a closed position with the reflective surfaces disposed in a substantially parallel juxtaposed relationship and an open position with the reflective surfaces defining an angle of ninety degrees, when the mitered side edges contact each other. A reflected image when viewed in the middle between the mirror units will be a non-reversed image.

8 Claims, 1 Drawing Sheet

TRUE IMAGE MIRROR

This is a continuation of Ser. No. 07/993,639, filed Dec. 21, 1992, now abandoned.

BACKGROUND OF THE INVENTION

The instant invention relates generally to mirror assemblies and more specifically it relates to a non-reversing image mirror device.

Numerous mirror assemblies have been provided in the prior art that are adapted to utilize at least two mirrors that focus on each other and in many cases cooperate in such a manner that the reflect image is not reversed. For example, U.S. Pat. Nos. 4,639,102 to Fetko et al.; 4,720,184 to Watson and 4,925,285 to Dowdell et al. all are illustrative of such prior art. While these units may be suitable for the particular purpose to which they address, they would not be as suitable for the purpose of the present invention as hereafter described.

SUMMARY OF THE INVENTION

A primary object of the present invention is to provide a non-reversing image mirror device that will overcome the shortcomings ;;:of the prior art devices.

Another object is to provide a non-reversing image mirror device that contains two hinged mirror units, so that when opened at a ninety degree position, the reflected image when viewed in the middle between the mirror units will be a non-reversed image.

An additional object is to provide a non-reversing image mirror device in which each of the two hinged mirror units contain a mitered forty-five degree angle edge, so that when the device is completely opened the mitered edges will contact each other to always maintain the device in its ninety degree position for proper viewing.

Yet an additional object is to provide a non-reversing image mirror device in which the image does not appear to have a split down the center as is the case with conventional related non-reversing prior art devices.

A further object is to provide a non-reversing image mirror device that is simple and easy to use.

A still further object is to provide a non-reversing image mirror device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
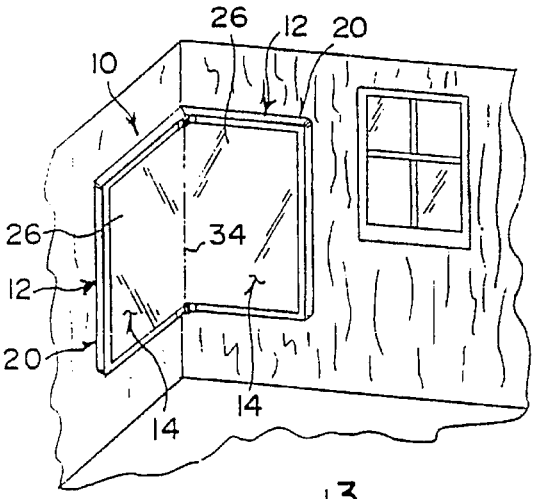
FIG. 1 is a diagrammatic front perspective view of the instant invention mounted in the corner of a room.
Figure 3:
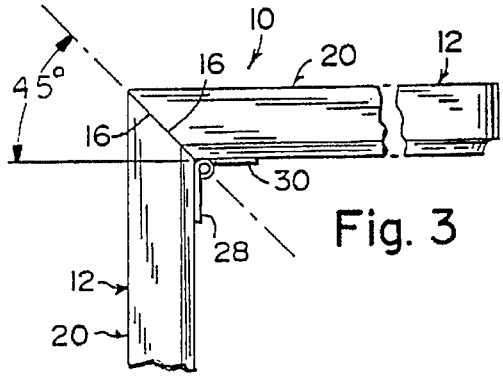
FIG. 3 is a top view with parts broken away taken in the direction of arrow 3 in FIG. 2.
Figure 5:
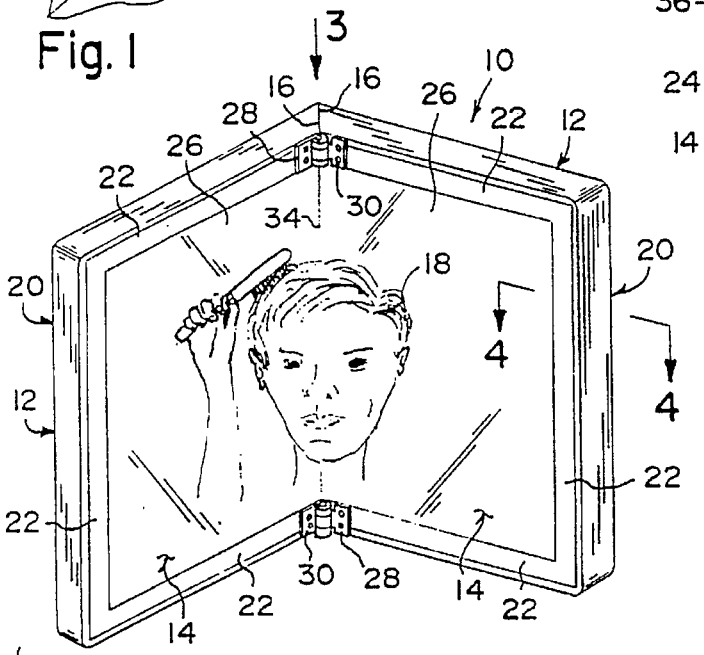
FIG. 5 is a top view with parts broken away taken in the direction of arrow 3 in FIG. 2, similar to FIG. 3, showing the instant invention in a folded state.
Figure 5:
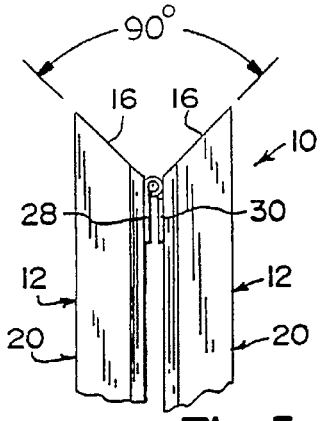
Figure 2:
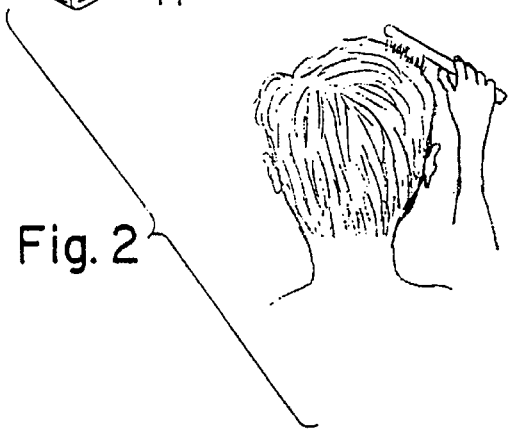
FIG. 2 is a diagrammatic front perspective view of the instant invention in use.

Turning now descriptively to the drawings, in which similar reference characters denote similar elements throughout the several views, the Figures illustrate a non-reversing image mirror device 10, which consists of a pair of identical mirror units 12, each having a substantially reflective surface 14 and a mitered side edge 16 angled at forty-five degrees. The mirror units 12 are pivotally connected together at the mitered side edges 16 for relative swinging of the mirror units 12 between a closed position, shown in FIG. 5, with the reflective surfaces 14 disposed in a substantially parallel juxtaposed relationship and an open position, shown in FIG. 1, 2 and 3 with the reflective surfaced 14 defining an angle of ninety degrees when the mitered side edges 16 contact each other, so that a reflected image when viewed in the middle between the mirror units 12 will be a non-reversed image 18.

Each mirror unit 12 includes a panel 20 having three raised sides 22 with a fourth side being the mitered side edge 16, so that the panel 20 will have a central recessed area 24. A mirror 26 is affixed to the central recessed area 24 of the panel 20. A set of male and female hinge portions 28 and 30 are spaced apart, with each secured to one of the raised sides 22 adjacent the mitered side edge 16. The mirror units 12 can be pivotally connected together with the male hinge portions 28 engaging with the female hinge portions 30.

Figure 6:
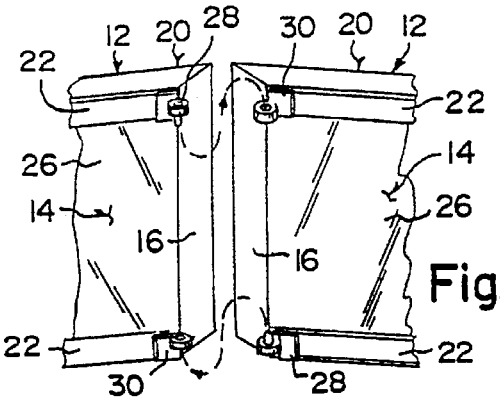
FIG. 6 is a diagrammatic front perspective view with parts broken away showing the two mirror units of the instant invention separated from each other in order to illustrate the hinge construction in greater detail.

As best seen in FIG. 6 each mirror unit 12 is constructed so that both halves that are identical to each other i.e. the right half and the left half are identical clones of each other. This is accomplished by arranging the hinges so that identical portions are located at identical location on each mirror unit 12 thereby requiring that only one kind of part is need to produce the instant invention.

Figure 4:
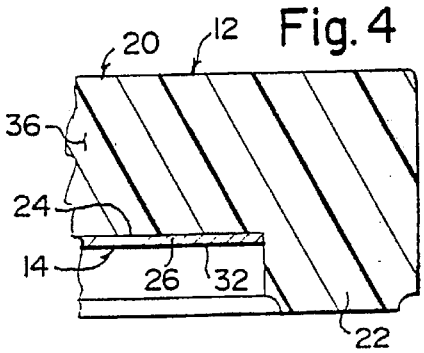
FIG. 4 is an enlarged cross sectional view taken on line 4—4 of FIG. 2.

As best illustrated in FIG. 4, it is extremely important that each mirror 26 is a front mirrored surface 32, so that when the mirror units 12 are in the open position the intersection of the two mirrors 26 will produce a center line split 34 which is virtually invisible or at least minimal compare to device mirrored on a rear surface. A preferred way of fabricating the mirror unit 12 is by injection molding the part out of a suitable plastic and then vacuum depositing a suitable reflective material upon the appropriate area to create a front mirrored surface 14. Alternatively each panel 12, as shown in FIG. 4, may be fabricated out of other durable strong material 36, typically but not limited to, wood, metal and similar materials, and then appropriately front mirrored by whatever process is applicable.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A non-reversing image mirror device which comprises a pair of mirror units, each having a substantially reflective front surface and a mitered side edge, said mirror units being rotatably connected to each other at said mitered side edges to provide relative rotation of said mirror units between a closed position and an open position wherein said reflective surfaces define an angle of ninety degrees and act cooperatively to form a single substantially seamless reflective region when said side edges are rotated to abut each other and form rotatable ninety-degree stop members, so that a reflected image when viewed in the middle between said mirror units is a non-reversed image having a center split which is virtually invisible.

2. A non-reversing image mirror device as recited in claim 1, wherein each said mirror unit includes:

a) a panel having three raised sides with a fourth side being said mitered side edge and being mitered at an angle of forty-five degrees, said sides forming a central recessed area;

b) a mirror affixed to said central recessed area of said panel; and c) hinge portions secured to said raised sides adjacent said mitered side edge to provide said relative rotation of said mirror units.

3. A non-reversing image mirror device as recited in claim 2, wherein said mirror units are identical to each other and all hinge portions are disposed at identical locations on each mirror unit thereby allowing said mirror device to be constructed using a single type of mirror unit.

4. A method of fabricating a non-reversing image mirror device, comprising the steps of:

a) forming a single kind of mirror unit having a side edge mitered at an angle of forty-five degrees;

b) creating a front surfaced mirror on said single kind of mirror unit; and c) rotatably connecting two of said single kind of mirror units such that when rotating the respective mitered side edges of said connected units to abut each other the mitered side edges act as rotatable ninety-degree stop members to position said front surfaced mirrors of said mirror units at a right angle to each other and cause said front surface mirrors to act cooperatively to form a single substantially seamless reflective region.

5. The method according to claim 4, wherein step (b) comprises providing a reflective surface on the front of at least one of said single mirror units.

6. The method according to claim 5, wherein step (b) comprises vacuum deposition of a reflective material upon said front surface of said single kind of mirror unit.

7. The method according to claim 4, comprising the further step of coupling hinges to said mirror units outside said single reflective region.

8. The non-reversing image mirror device as recited in claim 2, wherein said hinge portions are coupled to said panels in a location exterior to said single reflective region.

* * * * *